United States Patent [19]

Morgan

[11] 4,432,414

[45] Feb. 21, 1984

[54] DUAL CIRCUIT EMBOSSED SHEET HEAT TRANSFER PANEL

[75] Inventor: Grover D. Morgan, St. Louis County, Mo.

[73] Assignee: The United States of America are represented by the United States Department of Energy, Washington, D.C.

[21] Appl. No.: 410,680

[22] Filed: Aug. 23, 1982

[51] Int. Cl.[3] ..... F28F 3/12

[52] U.S. Cl. ..... 165/140; 165/170; 376/146

[58] Field of Search ..... 165/164, 165, 140, 170, 165/174, 173, 168; 122/512, 367 R

[56] References Cited

U.S. PATENT DOCUMENTS 2,950,093 8/1960 Krempel ..... 165/170

4,243,020 1/1981 Mier ..... 165/170

FOREIGN PATENT DOCUMENTS 452334 7/1944 Canada ..... 165/170

*Primary Examiner*—William R. Cline

*Assistant Examiner*—Daniel Costello

*Attorney, Agent, or Firm*—Bruce R. Mansfield; Paul A. Gottlieb

[57] ABSTRACT

A heat transfer panel provides redundant cooling for fusion reactors or the like environment requiring low-mass construction. Redundant cooling is provided by two independent cooling circuits, each circuit consisting of a series of channels joined to inlet and outlet headers. The panel comprises a welded joinder of two full-size and two much smaller partial-size sheets. The first full-size sheet is embossed to form first portions of channels for the first and second circuits, as well as a header for the first circuit. The second full-sized sheet is then laid over and welded to the first full-size sheet. The first and second partial-size sheets are then overlaid on separate portions of the second full-sized sheet, and are welded thereto. The first and second partial-sized sheets are embossed to form inlet and outlet headers, which communicate with channels of the second circuit through apertures formed in the second full-sized sheet.

9 Claims, 6 Drawing Figures

DUAL CIRCUIT EMBOSSED SHEET HEAT TRANSFER PANEL

CONTRACTUAL ORIGIN OF THE INVENTION

The U.S. Government has rights in this invention pursuant to Subcontract No. W-31-109-38-5108 with McDonnell Douglas Corporation, under Contract No. W-31-109-ENG-38 between the U.S. Department of Energy and Argonne National Laboratory.

BACKGROUND OF THE INVENTION

This invention pertains to forced-circulation heat transfer devices of the flat-plate type or embossed-sheet type. Dual circuit heat transfer systems are typically employed where different flow components of a system must be maintained in chemical or pressure isolation, or where redundancy of a heat transfer system is required. The latter situation is encountered in fusion reactor design, especially a forced-circulation-cooled first wall of a reactor facing a plasma. In such applications, the mass of the wall in contact with the plasma must be kept to a minimum to reduce neutron absorption and thereby increase the breeding of tritium as fuel, since neutron multiplier and lithium lithium-containing materials are typically located immediately behind the first wall. Further, the redundancy provided must allow for uniform cooling over all portions of the first wall during and after the plasma "burn" time period, so as to eliminate local hot spots occurring in out-of-service cooling circuits.

Embossed sheet-panel construction offers several advantages for fusion reactor application. In this type of construction, two sheets, one or both of which are embossed or corrugated, are joined together to form a series of coolant passageways. The sheets are typically joined by a continuous resistance weld, a method which causes minimal impact on the radiation damage resistance of the sheet material, in that the micro-structure of the sheet material is not markedly changed in the weld area. However, embossed-sheet panel constructions available today having more than one coolant circuit are not suitable for use as the redundant cooling system for nuclear reactors as described above. The multiple circuits in such constructions have inlet and outlet manifolds which are common to all circuits in a given panel, and thus do not offer coolant circuit redundancy since an entire panel must be placed out-of-service in order to place any of the multiple channels in an out-of-service condition. This would result in damage to the out-of-service panel when used in a high heat load application or when cooling down an irradiated panel after ending a plasma burn.

Other constructions available today use three full sheets of panel material, with coolant channels formed on both sides of a flat middle sheet by the two other embossed sheets. These constructions offer redundancy adequate for cooldown of an irradiated panel, but do not provide adequate panel cooling if the circuit on the high heat load side (plasma-facing side) is placed in an out-of-service condition. Also, such constructions require three or more full sheets of panel material and two full layers of coolant channels, which is unsuitable for use in a cooling member exposed to a plasma of a nuclear reactor, since the overall skin thickness of the cooling member causes high neutron absorption rates, and also if the coolant is water, the neutron energies are moderated (reduced) to an undsirable level.

SUMMARY OF THE INVENTION

It is therefore an object of the present invention to provide an embossed-sheet heat transfer panel having uniform redundant cooling of a single panel surface.

It is another object of the present invention to provide a dual circuit embossed-sheet heat transfer panel of the above-described type which is constructed of a minimum number of sheets and coolant channels, and which has a minimum overall wall thickness.

It is yet another object of the present invention to provide a dual circuit embossed-sheet heat transfer panel which comprises a first wall of a fusion reactor.

These and other objects of the present invention are provided by a heat transfer panel comprised of two full-size sheets and two smaller manifold members. The panel provides a first and a second redundant cooling circuit. Each circuit includes a plurality of channels joined to inlet and outlet headers unique to that circuit. The first full-size sheet is embossed to form continuous trough-like first portions of the channel members of the first and second cooling circuits, as well as trough-like first portions of the inlet and outlet headers for the first cooling circuit. The second full-size sheet is of flat-surface configuration and, when joined to the first sheet, encloses not only the trough-like portions of the first circuit channels and headers but also the second circuit channels. Each end of each channel of the second circuit is terminated in a dead-end fashion according to the embossed design of the first sheet. Apertures are located in the second sheet adjacent each dead-end portion of the second circuit channels. Third and fourth partial sheets in which inlet and outlet manifold channel members are embossed, respectively, are joined to the unenclosed side of the second sheet so as to overlie the apertures, completing construction of the second cooling circuit. The third and fourth sheets have a width that is small compared to the width of the first and second sheets and accordingly, the apertures are located close to an edge of the second sheet. The channels formed in the first sheet alternate between first and second cooling circuits, so that a channel of one circuit is surrounded by two channels of the other circuit, thus providing a maximally uniform redundant cooling throughout the heat transfer area. All portions of the sheets comprising the heat transfer panel are joined together by resistance welding with the exception of the welds between the second sheet and the edges of the third and fourth sheets nearer the apertures, which is more readily accomplished by fillet-type weld methods.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE PREFERRED EMBODIMENT

Figure 1:
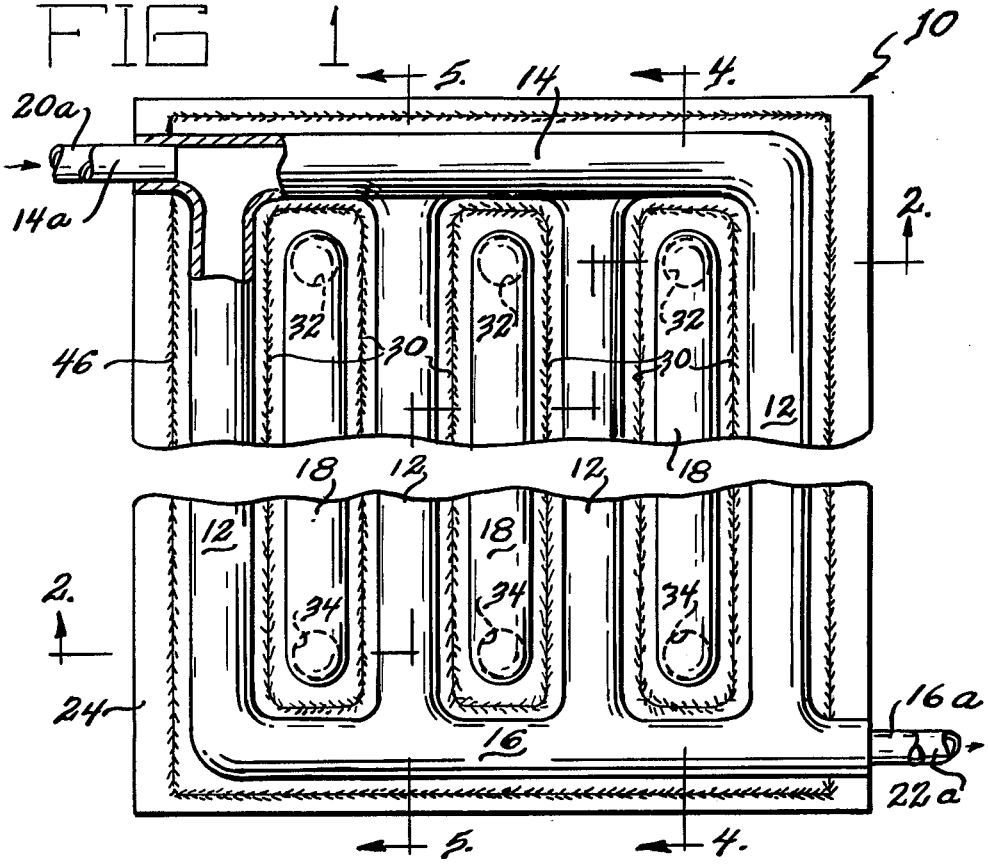
FIG. 1 is a plan view of the front side of a heat transfer panel according to the invention.
Figure 2:
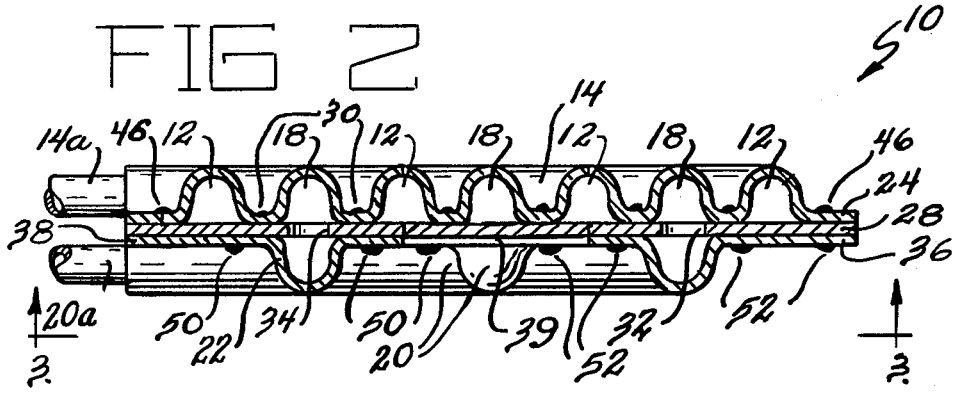
FIGS. 2, 4 and 5 are cross-sectional views taken along the lines 2—2 and 4—4, and 5—5 respectively, of FIG. 1.
Figure 3:
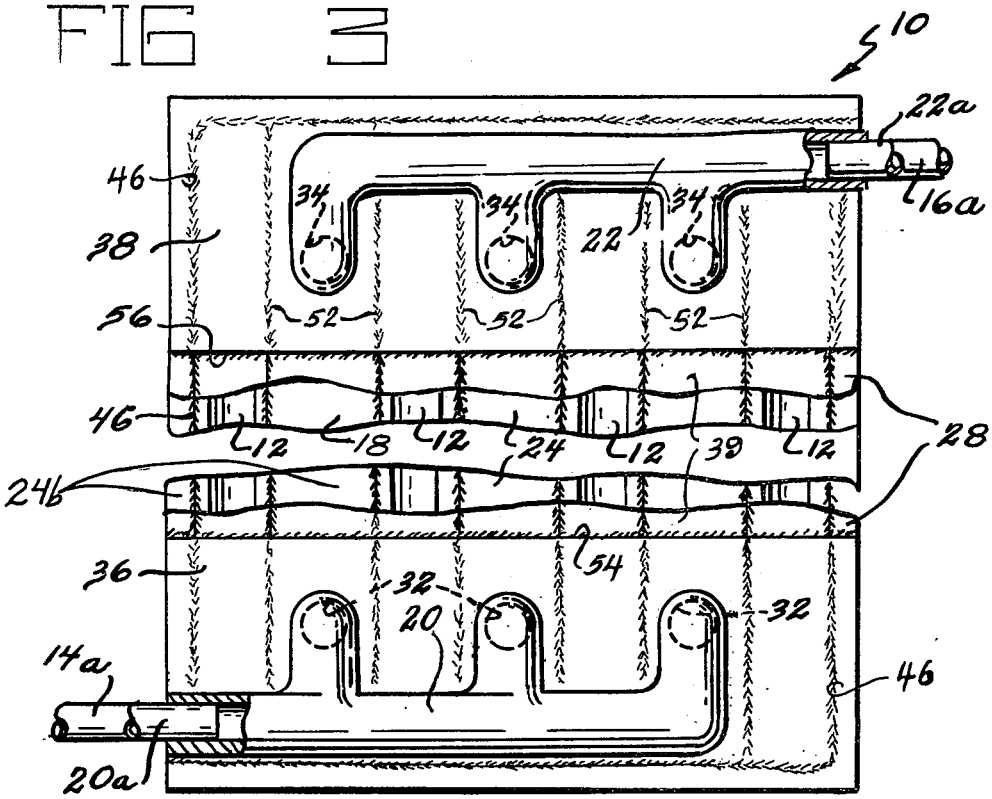
FIG. 3 is a partial plan view of the reverse side of the heat transfer panel of FIGS. 1 and 2.
Figure 4:
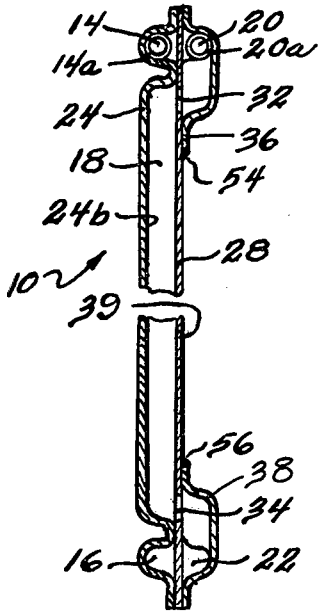
Figure 5:
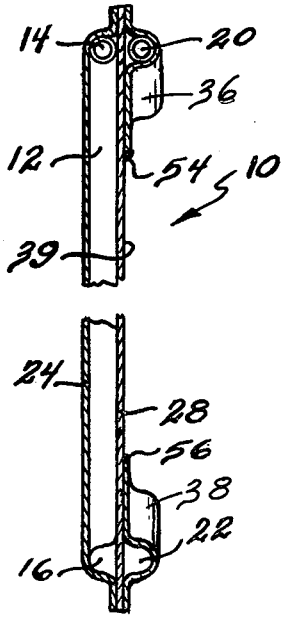

Referring now to the drawings, the general features of a heat transfer panel 10, which provides first and second redundant cooling circuits, will be described. Panel 10 is comprised of the welded joinder of two large, and two much smaller sheets as will be explained in greater detail herein. FIGS. 1 and 3 show front and back plan views of the heat transfer panel, wherein the only working heat absorbing surfaces of the panel are visible in FIG. 1. A first cooling circuit comprises a first series of channels 12 connected to inlet and outlet headers 14, 16, respectively. A second cooling circuit comprises channels 18 which are connected to second inlet and outlet headers 20, 22, respectively (see FIG. 3). The first and second cooling circuits are separate and independent from each other and offer redundant cooling for the heat load applied to the surface of heat transfer panel 10 shown in FIG. 1. Tube-like connectors 14*a*, 20*a* are inserted in inlet headers 14, 20, respectively, and are welded thereto to provide connection to external coolant temperature-control circuits. Connectors 16*a*,22*a* are similarly provided for outlet headers 16,22. The preferred heat transfer surface, that shown in FIG. 1, presents a series of coolant channels, alternating between first and second cooling circuits. Such arrangements find particular application where redundant cooling capability is required for fail-safe operation.

Referring now to FIG. 1, heat transfer panel 10 is comprised of a first unitary sheet 24 in which first trough-like portions of channels 12, 18 and headers 14, 16 are formed by embossing or the like fabrication method. Panel 10 is further comprised of a second unitary flat-sheet 28 dimensioned to completely overlie sheet 24. Sheet 28, shown most clearly in FIGS. 2, 4, 5, and 6, is essentially flat, so as to conform to the interior surface 24*b* of sheet 24. When placed in contact with sheet 24, sheet 28 fully encloses channels 12 of the first cooling circuit, and partially encloses channels 18 of the second cooling circuit. Only partial enclosure of channels 18 is achieved at this stage of construction since inlet and outlet apertures 32, 34 respectively are formed in sheet 28 adjacent each end of each channel 18 to provide communication with interior portions of the channels 18. After alignment, sheets 24,28 are joined by resistance welding along the lines 30 which surround channels 18 (see FIGS. 1 and 6).

After first and second full-size sheets 24, 28 are joined together at welds 30, partial sheets 36, 38 are aligned on opposing edges of the joined subassembly of sheets 24, 28, as shown in FIG. 3. Sheets 36, 38 overlie the open unjoined side 39 of flat-sheet 28, so as to enclose the series of apertures 32, 34. Sheets 36, 38 are embossed to form first trough-like portions comprising inlet and outlet headers 20, 22, which in combination with channels 18, and apertures 32, 34, form the second cooling circuit. Each sheet 36, 38 is then joined to full-sized sheets 24, 28, by resistance welding along the outside perimeter of panel 10, as indicated by lines 46 of FIGS. 1, 3 and 6. This latter welding operation further joins sheets 24, 28 in that all three sheets 24, 28, 36 (or 24, 28, 38) are welded together. As a result of this welding operation, water-tight construction of channels 12 and headers 20, 22 is completed.

Figure 6:
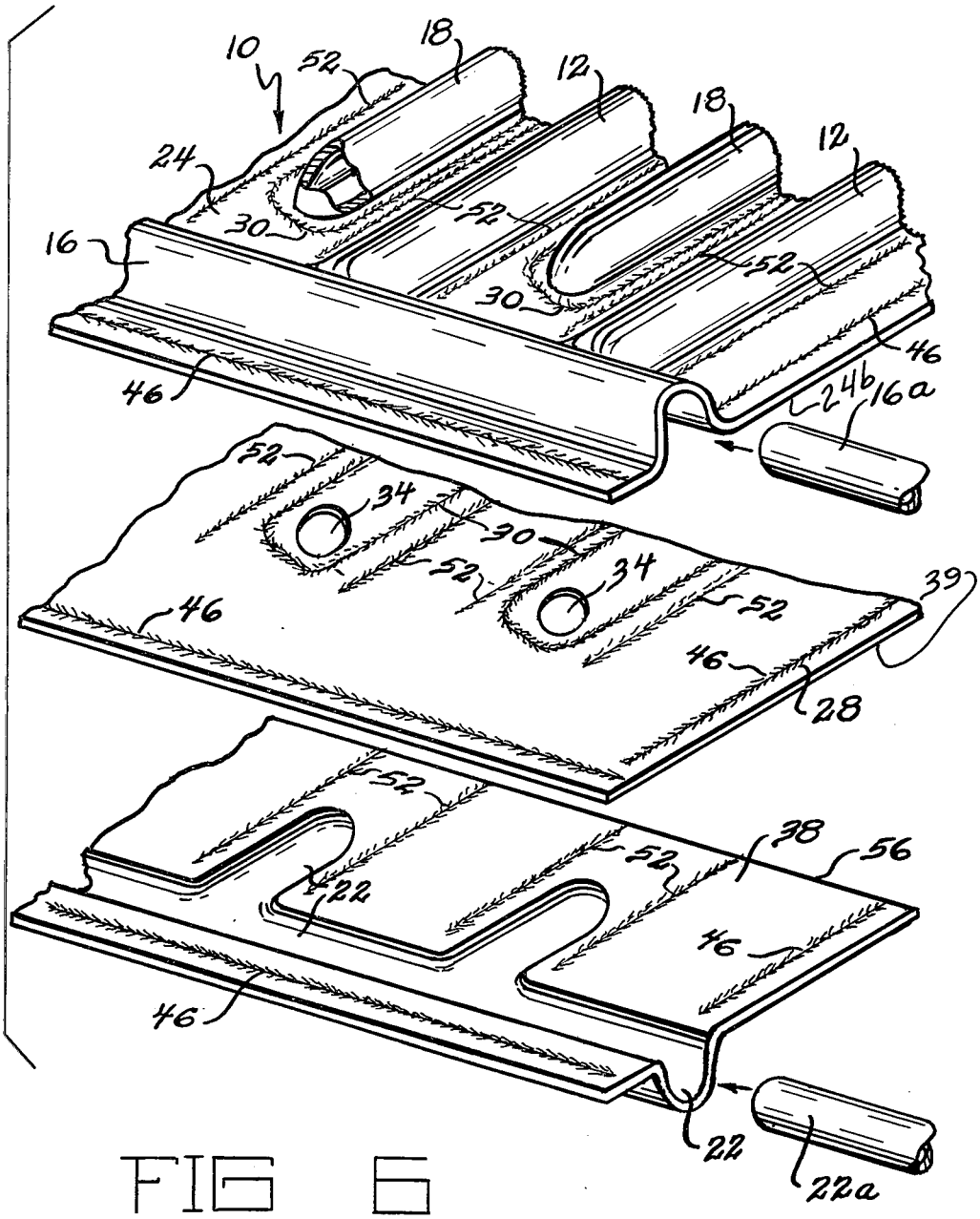
FIG. 6 is an exploded partial perspective view of the heat transfer panel according to the invention.

As shown most clearly in FIG. 6, cross flow between adjacent outlet apertures 34 is prevented by welding along lines 52 so as to join sheets 28,38. This forms water-tight, finger-like projections in sheet 38 which provide communication between apertures 34 and header 22. As shown in FIG. 6, welds 52 penetrate all three sheets 24, 28, 38 to further strengthen the construction of panel 10. Referring to FIG. 1, welds 52 are omitted for purposes of clarity. If shown in FIG. 1, welds 52 would lie immediately outside each weld 30, and would extend between inlet and outlet headers, as indicated in FIG. 3.

The foregoing description of the joinder of partial sheet 38 also applies to the joinder of the other partial sheet 36 wherein these constructions are mirror images of each other. Lastly, edge seams 54, 56 of partial sheets 36, 38 respectively, are formed by welding flat-sheet 28 to sheets 36, 38.

The heat transfer panel of the present invention finds particular application with fusion reactors where first wall confinement structures must have low mass to prevent neutron capture, thereby cooling the flux confined. Over most of its effective cooling area, the heat transfer panel of the present invention comprises only two layer construction, since the partial plates have a very small height compared to the overall height of the heat transfer panel. Further, the construction described above gives maximum strength for an available sheet thickness, therefore allowing a minimum sheet thickness, when adapted for use in a fusion environment. The heat transfer panel can comprise a portion of the first wall, or if maximum cooling is required, the entire first wall can be constructed of sections comprising heat transfer panels.

The embodiments of the invention in which an exclusive property or privilege is claimed are defined as follows:

1. A heat transfer panel having first and second independent cooling circuits for cooling a common surface, each cooling circuit consisting of a plurality of channels communicating with an inlet and an outlet header, said panel comprising:

a first sheet embossed to form first portions of the channels of said first and said second cooling circuits, and first portions of the inlet and outlet headers of the first cooling circuit;

a second sheet having first and second sides, said first side dimensioned to completely overlie said first sheet and joined to said first sheet to form channels and inlet and outlet headers of said first cooling circuit and channels of said second cooling circuit, said second sheet further having inlet and outlet apertures communicating with the channels of the second circuit; and third and fourth sheets dimensioned to overlie said inlet and outlet apertures of said second sheet, respectively, said third and said fourth sheets embosed to form first portions of said inlet and said outlet headers are joined to said second side of said second sheet at spaced-apart locations to form inlet and outlet headers of said second cooling circuit, respectively.

2. The arrangement of claim 1 wherein said channels of said first and said second cooling circuits are elongated and have predetermined lengths, respectively, and said first portion of said channels of said first and said second cooling circuits are coextensive with the lengths of said first and said second cooling circuits, respectively.

3. The arrangement of claim 2 wherein said inlet and said outlet headers are elongated and have predetermined lengths, respectively, and said first portions of said inlet and said outlet headers are coextensive with the lengths of said inlet and said outlet headers, respectively.

4. The arrangement of claim 3 wherein said channels of said second cooling circuit have opposing first and second ends, and said inlet and said outlet apertures of said second sheet are located adjacent said first and said second ends, respectively.

5. The arrangement of claim 4 wherein said channels of said first cooling circuit are interposed between said channels of said second cooling circuit.

6. The arrangement of claim 5 wherein said channels of said first and said second cooling circuits are parallel to each other.

7. The arrangement of claim 6 wherein said inlet and said outlet apertures of said second sheet form spaced-apart linear inlet and outlet arrays, respectively.

8. The arrangement of claim 7 wherein said common surface to be cooled by said first and said second cooling circuits comprises said first side of said first sheet.

9. The arrangement of claim 8 wherein said first sheet comprises a first wall of a nuclear reactor.

* * * * *